United States Patent [19]

Faragher, Jr.

[11] 4,202,059

[45] May 13, 1980

[54] REVERSIBLE SHOWER CURTAIN

[76] Inventor: Raymond F. Faragher, Jr., 620 Sunset Ct., Kenton Hills, Ky. 41011

[21] Appl. No.: 818,803

[22] Filed: Jul. 25, 1977

[51] Int. Cl.[2] ..... A47K 3/14

[52] U.S. Cl. ..... 4/149; 160/330

[58] Field of Search ..... 4/149; 160/DIG. 6, 327, 160/330

[56] References Cited

U.S. PATENT DOCUMENTS

| | | | |
|---|---|---|---|
| 2,069,600 | 2/1937 | Coleman | 4/149 |
| 3,084,738 | 4/1963 | Truesdale | 160/330 |
| 3,372,729 | 3/1968 | Lindenmayer | 160/330 |

*Primary Examiner*—Willis Little

*Attorney, Agent, or Firm*—Wood, Herron & Evans

[57] ABSTRACT

A reversible shower curtain includes a two sheet laminate, each sheet being co-extensive, and a curtain header structure including a stiffening strip attached to an upper edge of one sheet and a covering strip over said stiffening strip. The covering strip is made from the same material as the sheet to which the stiffening strip is attached.

7 Claims, 2 Drawing Figures

REVERSIBLE SHOWER CURTAIN

Figure 1:
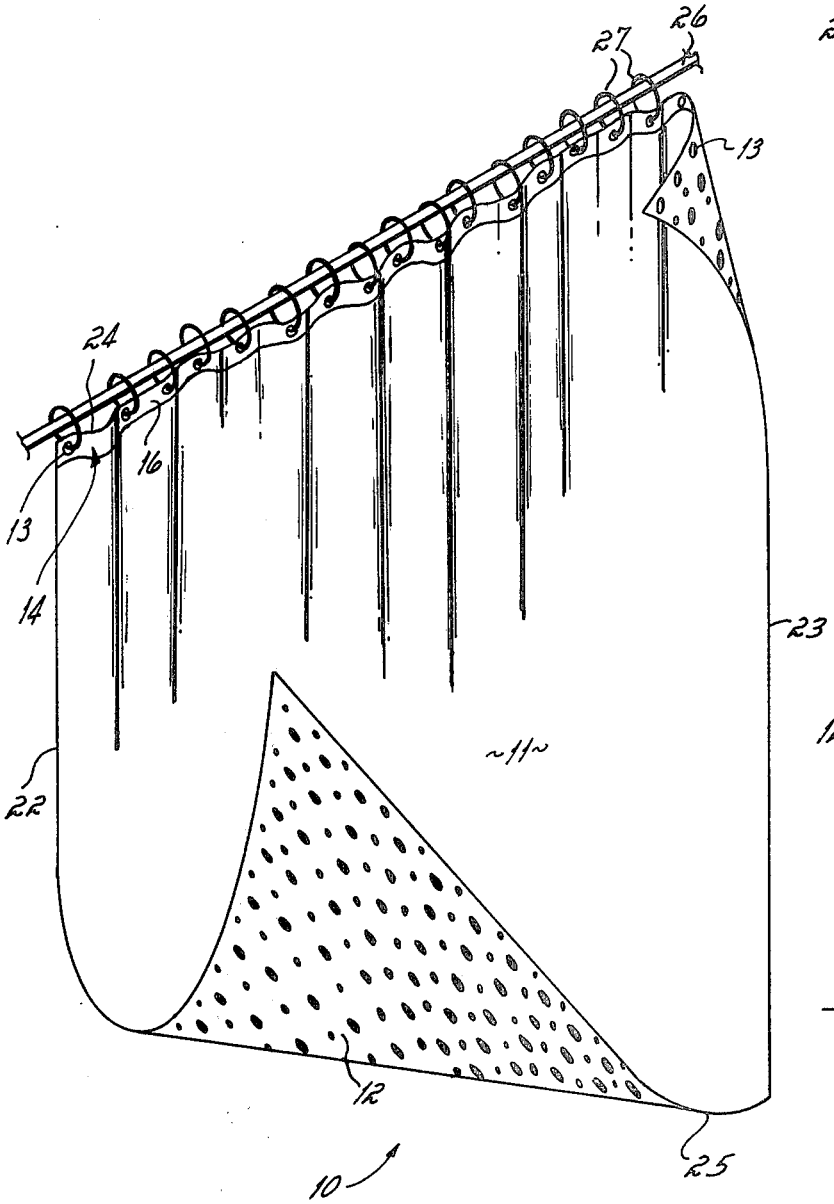

This invention relates to shower curtains and more particularly to a long wearing reversible shower curtain.

It is known in the shower curtain industry to manufacture curtains from two laminated plastic sheets of different colors. Heretofore, however, such curtains have not been practically reversible for several reasons. For example, in one form of laminated curtain, the laminate sheets are not co-extensive, rather the edges of a first laminate are folded over the ends of a second laminate and sealed, the fold-over constituting an edge of different color bordering the second laminate. Thus, the side presented by the second laminate is not uniformly one color or pattern, unless the two laminates are the same, which defeats the purpose of a reversible curtain. Also, the fold-over provides a seam on the second laminate which may be unsightly.

A second difficulty with prior curtains is in the header structure. While others have used an additional strip in the header, it must normally be made from a different or thicker material than that of the curtain in order to be effective. This constitutes an obstacle to the manufacture of a reversible curtain due to the fact that it is very difficult to match the color and/or embossment of the additional strip with that of the curtain. Even if the color is empirically matched, the differences in the backing or laminates to which they are mounted, when dealing with thin vinyls, for example, tend to produce different color effects.

It has thus been one objective of the invention to provide a uniformly reversible shower curtain.

Another objective of the invention has been to provide a long wearing uniform reversible shower curtain having two sides of differing colors or patterns.

A further objective of the invention has been to provide a reversible shower curtain having an improved header construction, the sides of which match each respective side of the curtain.

To these ends, a preferred embodiment of the invention comprises a uniformly reversible shower curtain comprising two curtain sheets laminated together and co-extensive throughout. The curtain header construction includes a stiffening strip, sealed at edges thereof to one laminate side at the top of the curtain, and a cover or header strip of the same material, embossment, color and pattern (if any) as that of the laminate to which the stiffening strip is sealed. The cover strip is sealed, along edges thereof, in a position to cover, and thus conceal, the stiffener. The co-extensive construction of the curtain laminate sides, together with the stiffening and cover strip not only provide a uniform reversible curtain where each side is uniform in material, embossment, color or pattern from top-to-bottom and from end-to-end, but the laminates, together with the stiffening and cover strips, provide a very strong and long wearing four-ply header construction without disturbing the uniform aesthetic appearance of either curtain side.

The uniform reversibility of the curtain permits the user to select one side or the other as he wishes, without having to accept a non-uniform or irregular border or header for example. This feature is a very significant one for the retail outlet in terms of providing a means of substantially reducing on-hand inventory. Since either side of the curtain can be turned outwardly, and the curtain thus used without consideration of the color or pattern on the opposite side, a retailer can cut his inventory in half, one reversible curtain presenting two aesthetic effects taking the place of two curtains which are not uniformly reversible and thus which provide only one side each for decorative purposes.

Figure 2:
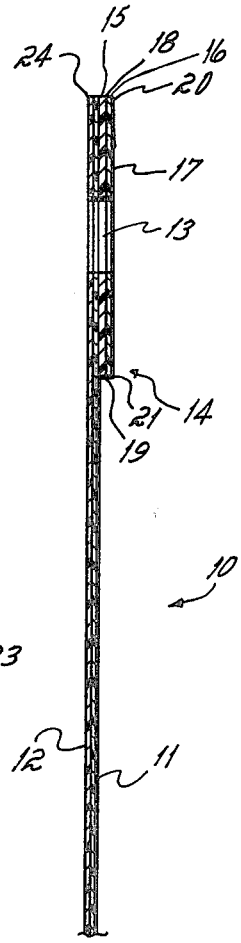

These and other advantages will become readily apparent from the following detailed description of a preferred embodiment, and from the drawings in which:

FIG. 1 is a perspective view of a preferred embodiment of the curtain invention, showing corners thereof turned back for the purposes of illustration; and FIG. 2 is a cross-sectional view of the curtain of FIG. 1.

Turning now to the drawings, there is shown in FIG. 1 thereof a reversible shower curtain 10 according to the invention. As shown in FIG. 1 thereof, each side of the shower curtain is uniform in color or pattern from top-to-bottom and from side-to-side. That is, side or sheet 11 is of a single solid color which extends from the top to the bottom and from one end to the other thereof without interruption, borders of different colors or the like. Likewise, side or sheet 12 is uniformly patterned from top-to-bottom and from end-to-end without any irregular or non-uniform interruption.

The details of the curtain construction are best seen in cross-sectional view in FIG. 2. The curtain principally comprises two sheets 11 and 12 each being made from a plastic material, such as polyethylene or vinyl or any suitable type. The sheet 11 is provided in a solid color while the sheet 12 is provided with a pattern. Of course, either sheet could be colored in any selected color, patterned, embossed, or otherwise decorated to provide the desired effect. Also, both sheets could be similarly colored or patterned if a single color is desired in a long wearing curtain provided by the structure of this invention.

The curtain is of such height and width to cover an appropriate bath opening, for example, and is supported in the normal manner via a curtain rod 26 and hooks 27 which extend through holes 13 located in a header construction 14 of the curtain at the top edge thereof. The header construction 14 is best seen in FIG. 2 where it will be noted that the header construction comprises sheets 11 and 12, together with a stiffening strip 15 and a cover or header strip 16. It will be appreciated that the cover or header strip 16 has an outer side 17 which is of the same color as the sheet 11 so that the sheet 11 is uniform in color from the very top edge of the header 14 to the bottom of the curtain.

The two sheets 11 and 12 are in this preferred embodiment each approximately formed from 5 gauge plastic material, while the stiffener strip 15 is formed of a relatively stiff 9 gauge material, and the cover or header strip 16 is formed from the same 5 gauge material as the sheet 11. Thus the total header thickness is about 24 gauge.

During manufacture of the curtain, the two laminated sheets 11 and 12 are provided in roll form and are thereafter unrolled, the stiffening and cover strips added and the curtain cut to size. The stiffening strip 15 and the cover or header strip 16 are secured to the curtain to form a header construction 14 by means of a heat sealing operation wherein edges 18 and 19 of the stiffening strip edges 20 and 21 of the cover or header strip are sealed together and to sheet 11 along parallel lines of seal along the top portion of the curtain 10. The top line of seal is adjacent the very top edge of the curtain, and the lower line of seal is spaced therefrom at the edge portion 19 and 21 of the respective stiffening and header strips, as best shown in FIG. 2. After the header construction has been formed by the heat sealing operation, the holes 13 are formed by appropriate punching and sealing. Accordingly, it will be appreciated that the header construction provides a four-ply header totalling 24 gauge in thickness, although it will also be noted that neither the stiffener strip nor the cover strip are heat sealed to each other between their edges, nor is the stiffener strip 15 sealed to the sheet 11, except at its edges. This provides a relatively long wearing header construction, while at the same time does not render the header too stiff so that it will not fold as the curtain is opened or closed along the rod 26.

It should also be appreciated that each side of the curtain 10 is completely uniform and there are no folded over edges, bottoms or seams which detract from the aesthetic appearance of the curtain. Thus, the curtain can be turned to either side without regard to the color or pattern which exists on the other side of the curtain, each side being complete and uniform from end 22 to end 23 and from top 24 to bottom 25.

Thus, where each side of the curtain is selected to coordinate with a particular decor, the curtain can be reversed, each side of the curtain presenting an entirely finished side from an aesthetic standpoint. On the other hand, if only one side of the curtain coordinates with the specific decor, it can be used without regard to what is on the opposite side thereof which is faced toward the tub or shower and not generally visible except to someone taking a shower. Of course, it should be appreciated that a curtain according to this invention may be constructed of matching sheets and cover strips so that a single color or pattern long wearing curtain is provided.

Accordingly, it will be appreciated that these and other advantages and modifications will become readily apparent to those of ordinary skill in the art without departing from the scope of this invention, and the applicant intends to be bound only by the claims appended hereto.

I claim:

1. A four-piece reversible shower curtain having two sides, each side presenting a different aesthetic appearance from the other side, said curtain consisting of:

a laminated curtain composite of two sheets, said sheets being coextensive from end-to-end and from top to bottom such that the edges of said curtain are absent of fold-over hems;

each of said sheets having an inner side laminated to the inner side of the other sheet and each of said sheets having an outer side being totally uniform in its design and color and totally independent of the outer side of said other sheet whereby, each outer side presents a different aesthetic appearance from the other outer side; and a header structure consisting of a stiffening strip attached to an outer side of one of said sheets at an upper edge portion thereof, and a separate cover strip attached to said one sheet and being coextensive with and covering said stiffening strip, the ends of said covering strip being coextensive with respective ends of said two sheets, and said two sheets extending coextensively beneath said cover and stiffening strips to form a major portion of said curtain;

said covering strip comprising aesthetically a continuation of the aesthetic appearance presented by the outer side of said one sheet such that said covering strip and said outer side of said one sheet together cooperate to produce a uniform aesthetic appearance different from that presented by the outer side of the other sheet;

said curtain being reversible such that the aesthetic appearance presented by one outer side is not visible to a person viewing the curtain from the opposite outer side thereof.

2. A reversible shower curtain as in claim 1 wherein each of said sheets is about 5 gauge in thickness, said stiffening strip is about 9 gauge in thickness, and said cover strip is about 5 gauge in thickness.

3. A reversible shower curtain as in claim 2 wherein said curtain components comprise vinyl material.

4. A reversible shower curtain as in claim 3 wherein said stiffening and said cover strip are heat sealed to the outer side of said one sheet.

5. A reversible shower curtain as in claim 4 wherein said stiffening strip and said cover strip are heat sealed to each other at edges thereof.

6. A reversible shower curtain as in claim 1 wherein said cover strip is about the same width as the stiffening strip.

7. A reversible shower curtain as in claim 1 wherein said cover strip comprises the same kind of material as said one sheet.

* * * * *